US011015559B2

(12) United States Patent
Hong et al.

(10) Patent No.: US 11,015,559 B2
(45) Date of Patent: May 25, 2021

(54) MULTI-HOLE FUEL INJECTOR WITH TWISTED NOZZLE HOLES

(71) Applicant: Ford Global Technologies, LLC, Dearborn, MI (US)

(72) Inventors: Sangjin Hong, Ann Arbor, MI (US); Xiaogang Zhang, Novi, MI (US); Mark Meinhart, Dexter, MI (US); Jianwen James Yi, West Bloomfiled, MI (US); Joseph Basmaji, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 94 days.

(21) Appl. No.: 16/047,946

(22) Filed: Jul. 27, 2018

(65) Prior Publication Data

US 2020/0032756 A1 Jan. 30, 2020

(51) Int. Cl.

| | |
|---|---|
| ***F02M 61/18*** | (2006.01) |
| ***F02M 45/08*** | (2006.01) |
| ***F02M 61/04*** | (2006.01) |

(52) U.S. Cl.

CPC ..... *F02M 61/1833* (2013.01); *F02M 45/086* (2013.01); *F02M 61/04* (2013.01); *F02M 61/184* (2013.01); *F02M 61/1806* (2013.01); *F02B 2275/14* (2013.01); *F02M 2200/46* (2013.01)

(58) Field of Classification Search

CPC ..... F02M 61/1833; F02M 61/1806; F02M 61/04; F02M 61/184; F02M 45/086; F02M 2200/46; F02B 2275/14

USPC ..... 239/463, 486, 487, 533.12, 548, 552, 239/556, 596, 601

See application file for complete search history.

(56) References Cited

U.S. PATENT DOCUMENTS

| | | | |
|---|---|---|---|
| 4,160,526 | A | 7/1979 | Flanagan |
| 4,570,598 | A | 2/1986 | Samson et al. |
| 4,974,415 | A | 12/1990 | Shekleton et al. |
| 5,833,141 | A | 11/1998 | Bechtel, II et al. |
| 5,979,802 | A | 11/1999 | Hasegawa |
| 6,029,913 | A | 2/2000 | Stroia et al. |
| 6,105,883 | A | 8/2000 | Takeda et al. |
| 6,230,983 | B1 | 5/2001 | Kasen |
| 6,543,133 | B2 | 4/2003 | D'Arrigo |
| 6,625,971 | B2 | 9/2003 | Graves |

(Continued)

FOREIGN PATENT DOCUMENTS

| | | |
|---|---|---|
| WO | 0231350 A2 | 4/2002 |

OTHER PUBLICATIONS

Kurtz, E., "Methods and Systems for a Fuel Injector," U.S. Appl. No. 15/804,965, filed Nov. 6, 2017, 51 pages.

(Continued)

*Primary Examiner* — Steven J Ganey

(74) *Attorney, Agent, or Firm* — Geoffrey Brumbaugh; McCoy Russell LLP

(57) ABSTRACT

Methods and systems are provided for a multi-hole nozzle of a fuel injector. In one example, a nozzle for a fuel injector may include multiple nozzle holes arranged at a nozzle tip, where each nozzle hole has a straight flow axis and a cross-section that twists around the straight flow axis, from an inlet to an outlet of the nozzle hole. Additionally, a long side of the cross-section may increase in length, along the nozzle hole, from the inlet to the outlet.

17 Claims, 6 Drawing Sheets

(56) References Cited

U.S. PATENT DOCUMENTS

| | | | | |
|---|---|---|---|---|
| 6,695,229 | B1 | 2/2004 | Heinbuch et al. | |
| 6,769,635 | B2 | 8/2004 | Stewart et al. | |
| 7,798,130 | B2 | 9/2010 | Allen | |
| 7,909,271 | B2 * | 3/2011 | Cavanagh | F02M 61/1826 239/533.12 |
| 8,490,888 | B2 | 7/2013 | Greeves et al. | |
| 8,672,239 | B2 * | 3/2014 | Ogura | F02M 61/1846 239/533.12 |
| 9,518,547 | B2 | 12/2016 | John | |
| 9,556,844 | B2 * | 1/2017 | Rowan | F02M 61/1806 |
| 9,581,113 | B2 | 2/2017 | Bandyopadhyay et al. | |
| 9,840,994 | B2 | 12/2017 | Zhang | |
| 9,845,780 | B2 | 12/2017 | Zhang | |
| 10,077,724 | B1 | 9/2018 | Kurtz et al. | |
| 2010/0183993 | A1 | 7/2010 | McAlister | |
| 2013/0313339 | A1 * | 11/2013 | Carpenter | F02M 61/1853 239/548 |
| 2015/0361938 | A1 | 12/2015 | Ogura et al. | |
| 2017/0175667 | A1 | 6/2017 | Zhang | |
| 2020/0025060 | A1 * | 1/2020 | Parrish | F02M 51/0664 |

OTHER PUBLICATIONS

Zhang, X., "Methods and Systems for a Fuel Injector," U.S. Appl. No. 15/921,335, filed Mar. 14, 2018, 36 pages.

Zhang, X. et al., "Methods and Systems for a Fuel Injector," U.S. Appl. No. 15/921,516, filed Mar. 14, 2018, 46 pages.

* cited by examiner

MULTI-HOLE FUEL INJECTOR WITH TWISTED NOZZLE HOLES

FIELD

The present description relates generally to a direct fuel injector in a fuel delivery system of an engine.

BACKGROUND/SUMMARY

Fuel delivery systems in internal combustion engines have employed fuel injectors to deliver fuel directly into engine combustion chambers. In gasoline engines, the engine geometry may not be symmetric with respect to the location of the fuel injector. As a result, distances between the fuel injector and the engine cylinder surfaces may vary across the engine cylinder. Thus, multi-hole injectors, which have a nozzle with multiple nozzle holes, may be used to provide multiple holes with different injection directions to account for the varying distances between the injector and engine cylinder surfaces and other geometry constraints such as positioning of valves. It is important that the spray characteristics of the fuel injector are optimized to reduce surface wetting and increase mixing of injected fuel with air inside the combustion chamber (e.g., cylinder). Surface wetting is the amount of fuel that reaches the walls of the combustion chamber and port surfaces. Decreasing the amount of fuel that reaches the combustion chamber surfaces reduces engine emissions. Additionally, increasing mixing increases fuel economy and decreases emissions. Multi-hole injectors may allow surface wetting to be reduced due to injector location. However, due to more stringent emissions regulations, even further reductions in surface wetting and increases in fuel mixing may be desired.

Other attempts to enhance atomization and fuel/air mixing with fuel injectors include adapting the nozzle holes of the fuel injector to create a swirl motion. One example approach is shown by Stroia et al. in U.S. Pat. No. 6,029,913. Therein, a multi-hole injector is disclosed where each hole has an oval cross-section and curves relative to a central axis of the injector. These nozzle holes generate a swirl motion that increases fuel atomization and fuel/air mixing.

However, the inventors herein have recognized potential issues with such systems. As one example, injector holes that curve relative to the central axis of the injector, in the same direction, generate a rotating cone surface spray pattern. This pattern may increase fuel/air mixing; however, the travel distance of the injected fuel spray may not be able to be controlled, especially for asymmetric combustion chambers with respect to the injector location. As a result, this design of the nozzle holes may have increased surface wetting, thereby increasing engine emissions.

In one example, the issues described above may be addressed by a nozzle of a fuel injector, comprising: a plurality of nozzle holes, each nozzle hole having a straight flow axis, along a length of each nozzle hole, and a cross-section that twists around the straight flow axis, from an inlet to outlet of each nozzle hole, where the straight flow axis runs through a center of the cross-section. In this way, two velocity components of the injected fuel (rotational and straight) are created at each nozzle hole, thereby enhancing mixing due to the additional motion of the injected spray and reducing surface wetting by decreasing the travel distance from each nozzle hole to the engine cylinder surfaces.

As one example, the aspect ratio of the cross-section may be adjusted. For example, the aspect ratio may change from the inlet to the outlet of the nozzle hole. Said another way, a long side of the shape of the cross-section may be changed (e.g., increased) from the inlet to the outlet of the nozzle hole. As one example, at the nozzle outlet, the width (e.g., long side) of the cross-section of the nozzle hole may be twice the length of the height (e.g., short side) of the cross-section of the nozzle hole. The angle of the twisted nozzle hole may also be varied (e.g., the amount the cross-section twists around the straight flow axis from the inlet to the outlet of the nozzle hole). By adjusting the twist angle and the aspect ratio of the nozzle hole, the spray shape (e.g., width of spray shape) and penetration depth may be controlled in order to reduce surface wetting and increasing mixing, thereby decreasing emissions. In some embodiments, the shape of the cross-section of the nozzle hole may be rectangular (e.g., slit-like) which may be advantageous in adjusting the spray shape and penetration depth to desired levels.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 4A-4B and 6 are shown approximately to scale.

DETAILED DESCRIPTION

Figure 1:
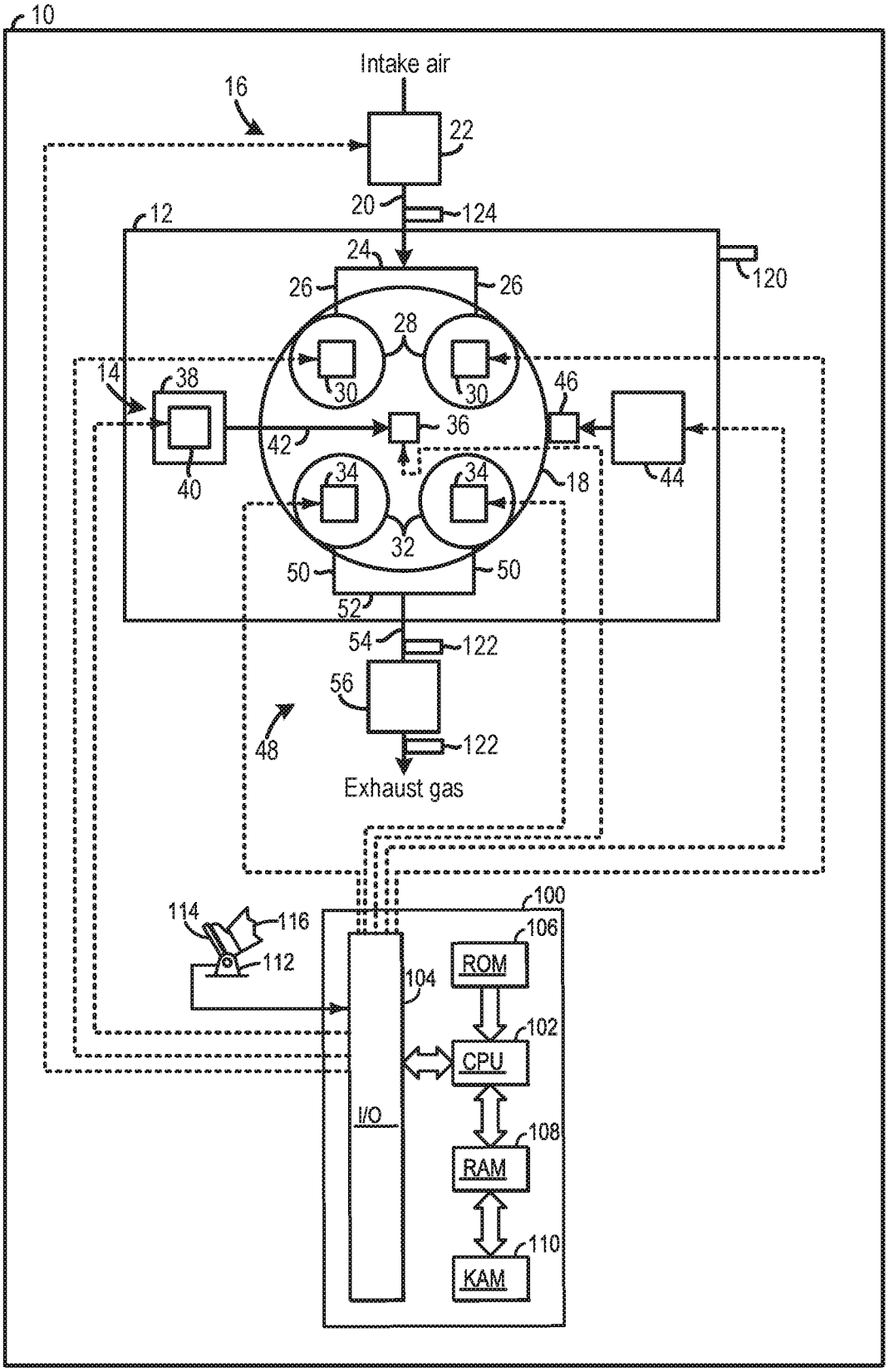
FIG. 1 shows a schematic depiction of an internal combustion engine.
Figure 2:
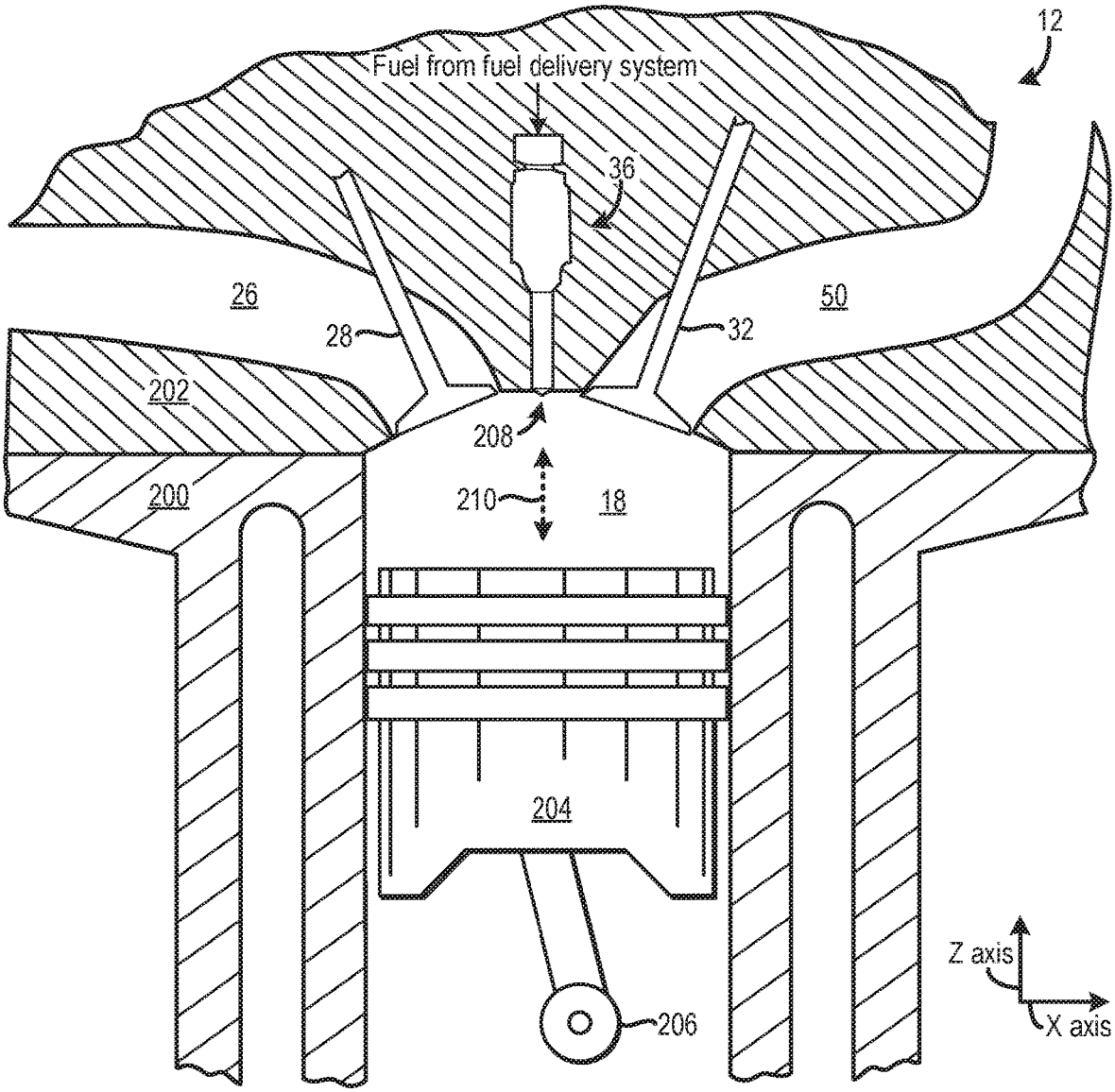
FIG. 2 shows an illustration of an example cylinder with a direct fuel injector in the internal combustion engine, shown in FIG. 1, in cross-section.
Figure 3A:
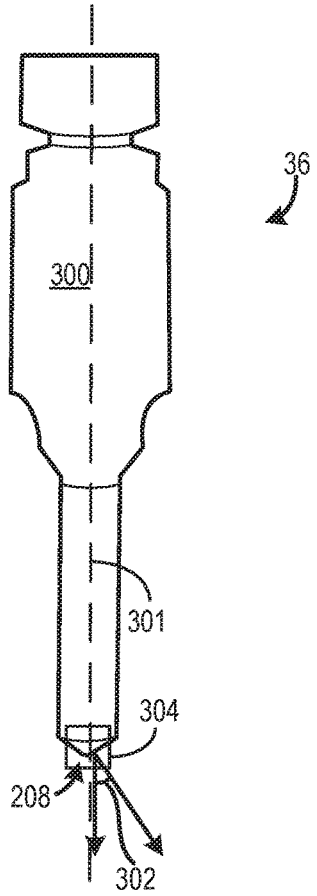
FIG. 3A shows a detailed illustration of the direct fuel injector shown in FIG. 2.
Figure 3B:
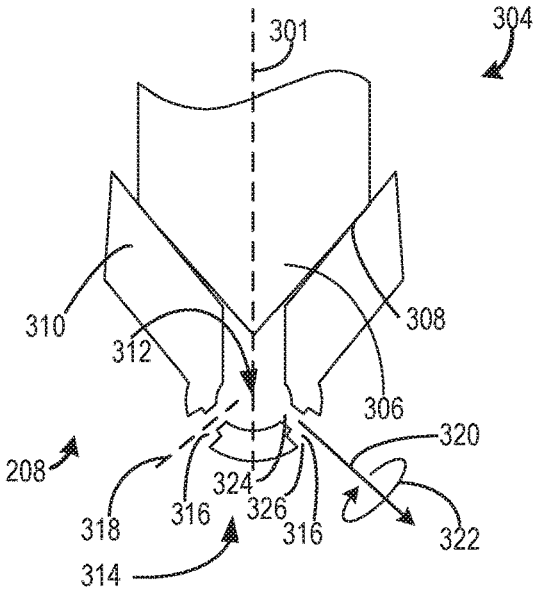
FIG. 3B shows a detailed illustration of the nozzle of the direct fuel injector of FIG. 3A.
Figure 4A:
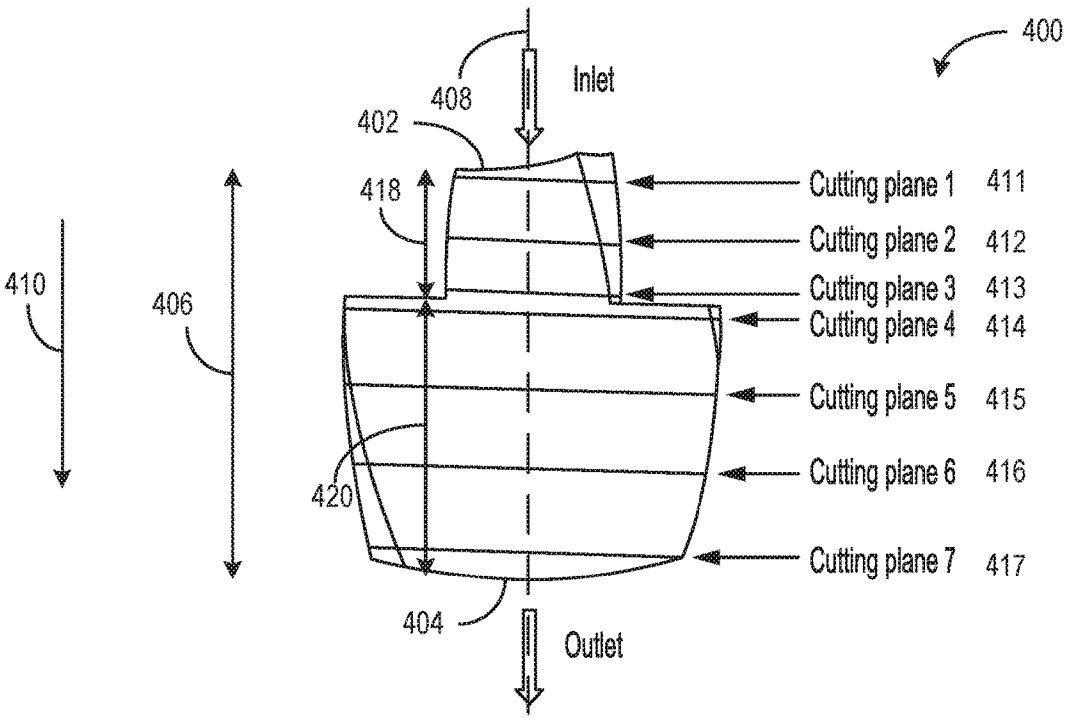
FIG. 4A shows a three-dimensional view of an embodiment of a twisted nozzle hole for a fuel injector.
Figure 4B:
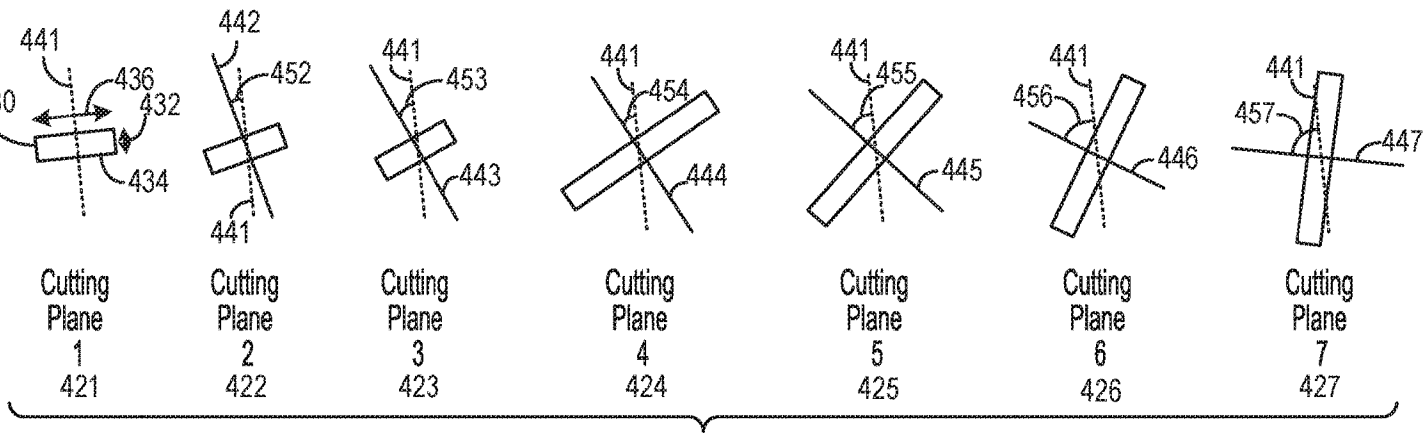
FIG. 4B shows a cross-section of the twisted nozzle hole of FIG. 4A, taken at a plurality of cutting planes along a length of the twisted nozzle hole.
Figure 5:
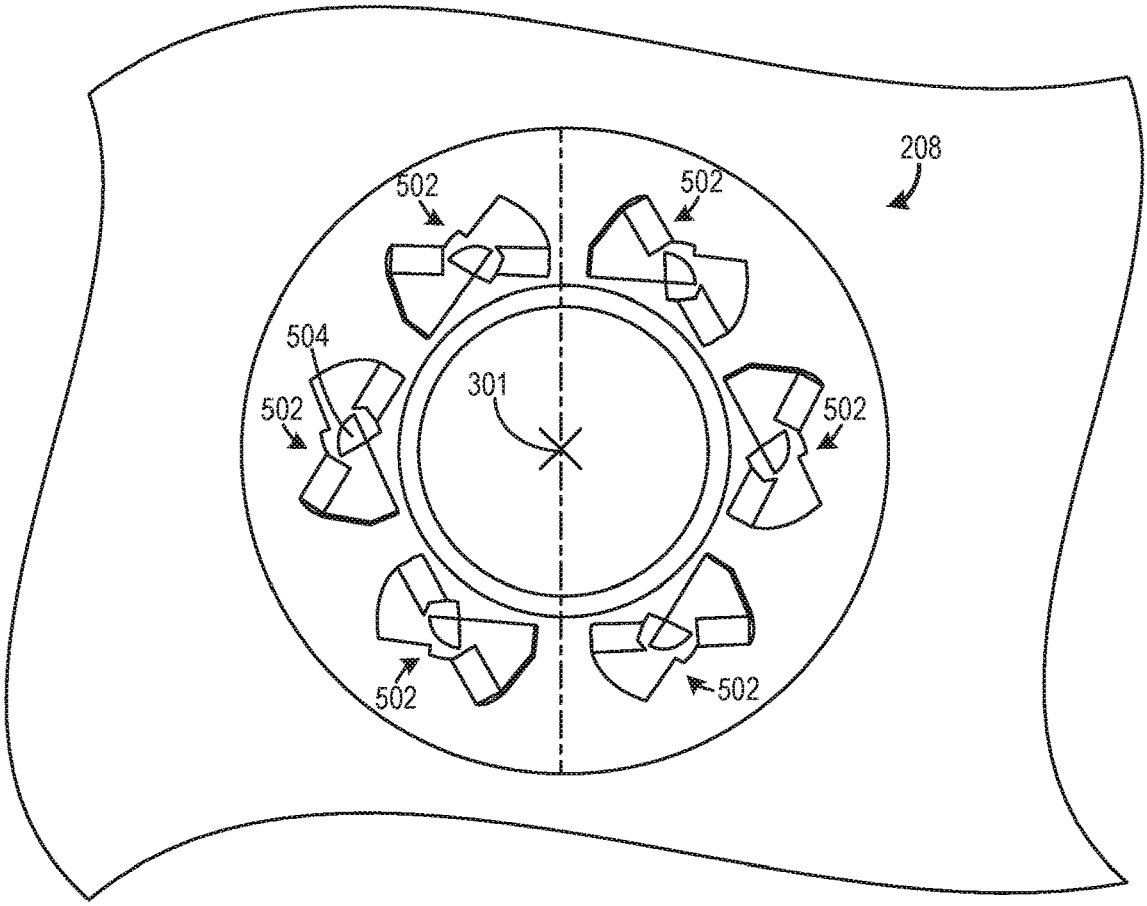
FIG. 5 shows a cross-sectional view of an embodiment of the nozzle included in the direct fuel injector shown in FIGS. 3A-3B, the view being from an inlet side of nozzle holes of the nozzle.
Figure 6:
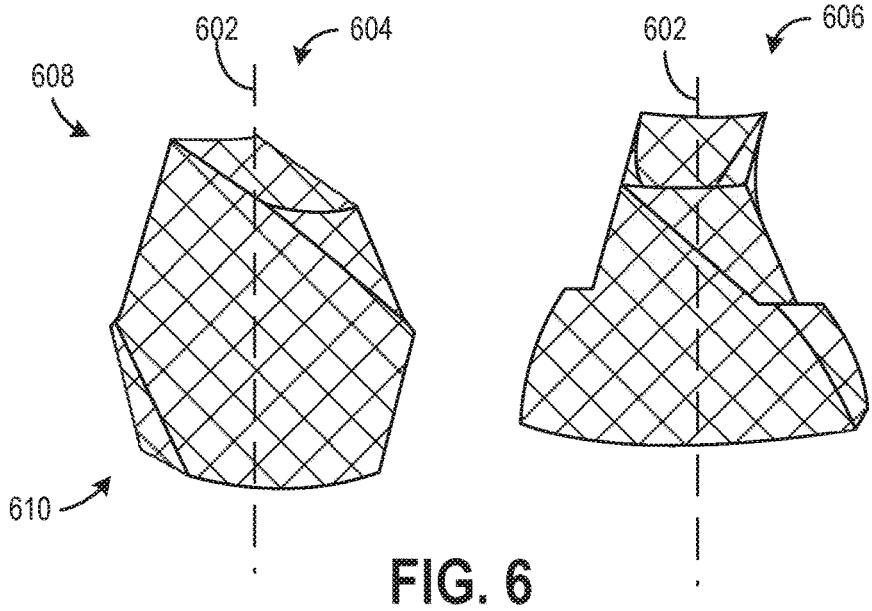
FIG. 6 shows a three-dimensional view of additional embodiments of a twisted nozzle hole for a fuel injector.
Figure 7:
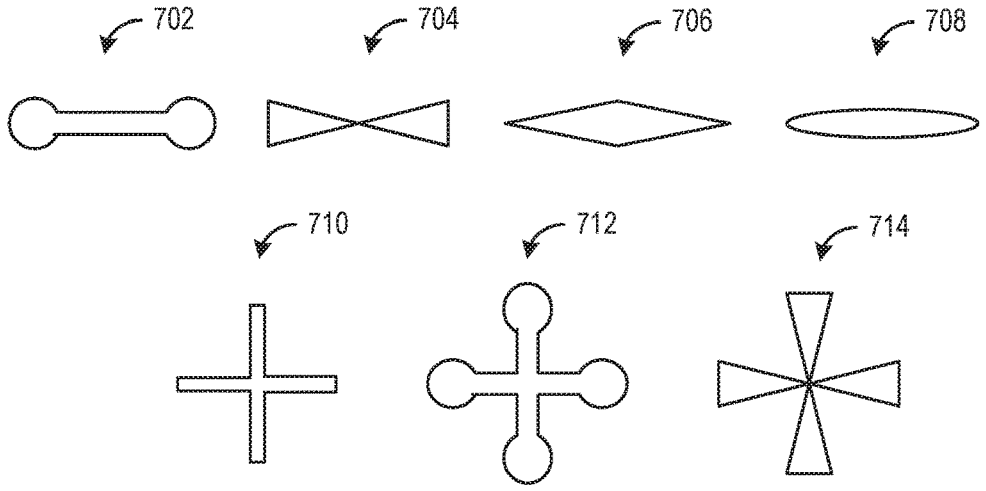
FIG. 7 shows alternative embodiments for a shape of the cross-section of the twisted nozzle hole of the nozzle.
Figure 8:
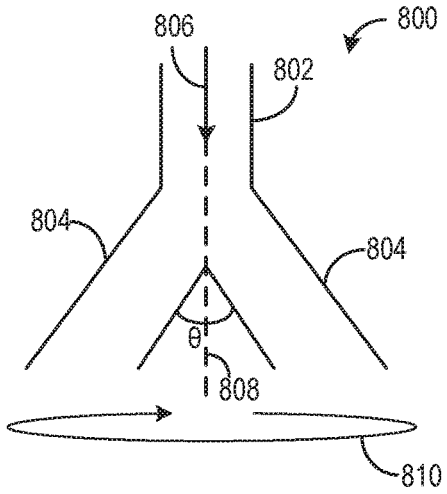
FIG. 8 shows an embodiment of a modified nozzle hole for a multi-hole nozzle which includes a straight nozzle hole passage that bifurcates into two angled nozzle hole passages.
Figure 9:
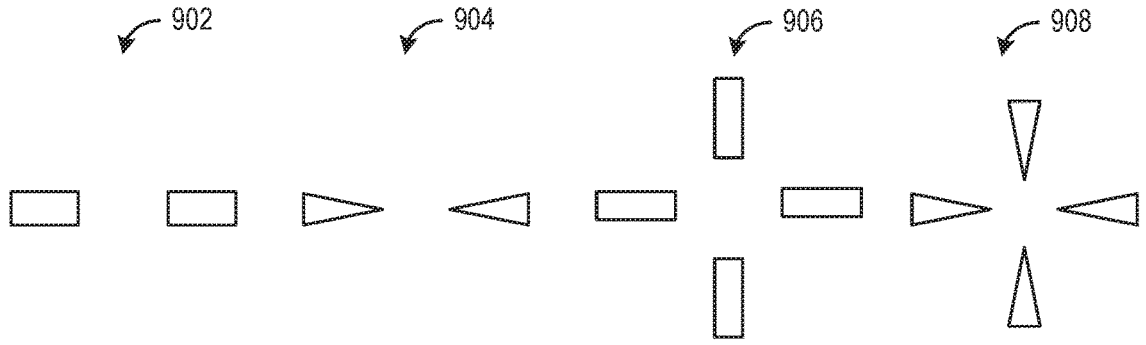
FIG. 9 shows example shapes of the cross-sections of the modified nozzle hole passage of FIG. 8.

The following description relates to a direct fuel injector in a fuel delivery system of an internal combustion engine, such as the engine shown in FIGS. 1 and 2. The direct, multi-hole fuel injector generates a spray pattern including multiple, individual sprays having different spray directions, as shown in FIGS. 3A-3B. Each nozzle hole may include a twisted passage with a cross-section that rotates around a straight flow axis of the nozzle hole, thereby creating a fuel spray with a straight velocity component and a rotational velocity component, as shown in FIG. 3B. Examples of the cross-section of the twisted nozzle hole, along a length of the nozzle hole, from an inlet to an outlet, is shown in FIGS. 4A-4B. Alternative embodiments of the twisted nozzle hole are shown in FIG. 6. Additionally, the nozzle of the fuel injector may include the twisted nozzle holes oriented around a central axis of the fuel injector, as shown at FIG. 5. Different embodiments of the nozzle hole passage and different possible shapes for the cross-section of the nozzle hole are shown in FIGS. 7-9. In this way, the twisted nozzle holes may create individual fuel sprays with two velocity components, resulting in increased fuel/air missing and decreased wall wetting, thereby decreasing emissions.

Turning to FIG. 1, a vehicle 10 having an engine 12 with a fuel delivery system 14 is schematically illustrated. Although, FIG. 1 provides a schematic depiction of various engine and fuel delivery system components, it will be appreciated that at least some of the components may have a different spatial positions and greater structural complexity than the components shown in FIG. 1. The structural details of the components are discussed in greater detail herein with regard to FIGS. 2-3B.

An intake system 16 providing intake air to a cylinder 18 is also depicted in FIG. 1. Although, FIG. 1 depicts the engine 12 with one cylinder, the engine 12 may have an alternate number of cylinders. For instance, the engine 12 may include two cylinders, three cylinders, six cylinders, etc., in other examples.

The intake system 16 includes an intake conduit 20 and a throttle 22 coupled to the intake conduit. The throttle 22 is configured to regulate the amount of airflow provided to the cylinder 18. In the depicted example, the intake conduit 20 feeds air to an intake manifold 24. The intake manifold 24 is coupled to and in fluidic communication with intake runners 26. The intake runners 26 in turn provide intake air to intake valves 28. In the illustrated example, two intake valves are depicted in FIG. 1. However, in other examples, the cylinder 18 may include a single intake valve or more than two intake valves. The intake manifold 24, intake runners 26, and intake valves 28 are included in the intake system 16.

The intake valves 28 may be actuated by intake valve actuators 30. Likewise, exhaust valves 32 coupled to the cylinder 18 may be actuated by exhaust valve actuators 34. In particular, each intake valve may be actuated by an associated intake valve actuator and each exhaust valve may be actuated by an associated exhaust valve actuator. In one example, the intake valve actuators 30 as well as the exhaust valve actuators 34 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. It will therefore be appreciated, that valve overlap may occur in the engine, if desired. In another example, the intake and/or exhaust valve actuators, 30 and 34, may be controlled by electric valve actuation. For example, the valve actuators, 30 and 34, may be electronic valve actuators controlled via electronic actuation. In yet another example, cylinder 18 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

The fuel delivery system 14 provides pressurized fuel to a direct fuel injector 36. The fuel delivery system 14 includes a fuel tank 38 storing liquid fuel (e.g., gasoline, diesel, bio-diesel, alcohol (e.g., ethanol and/or methanol) and/or combinations thereof). The fuel delivery system 14 further includes a fuel pump 40 pressurizing fuel and generating fuel flow to a direct fuel injector 36. A fuel conduit 42 provides fluidic communication between the fuel pump 40 and the direct fuel injector 36. The direct fuel injector 36 is coupled (e.g., directly coupled) to the cylinder 18. The direct fuel injector 36 is configured to provide metered amounts fuel to the cylinder 18. The fuel delivery system 14 may include additional components, not shown in FIG. 1. For instance, the fuel delivery system 14 may include a second fuel pump. In such an example, the first fuel pump may be a lift pump and the second fuel pump may be a high-pressure pump, for instance. Additional fuel delivery system components may include check valves, return lines, etc., to enable fuel to be provided to the injector at desired pressures.

An ignition system 44 (e.g., distributor less ignition system) is also included in the engine 12. The ignition system 44 provides an ignition spark to cylinder via ignition device 46 (e.g., spark plug) in response to control signals from the controller 100. However, in other examples, the engine may be designed to implement compression ignition, and therefore the ignition system may be omitted, in such an example.

An exhaust system 48 configured to manage exhaust gas from the cylinder 18 is also included in the vehicle 10, depicted in FIG. 1. The exhaust system 48 includes the exhaust valves 32 coupled to the cylinder 18. In particular, two exhaust valves are shown in FIG. 1. However, engines with an alternate number of exhaust valves have been contemplated, such as an engine with a single exhaust valve, three exhaust valves, etc. The exhaust valves 32 are in fluidic communication with exhaust runners 50. The exhaust runners 50 are coupled to and in fluidic communication with an exhaust manifold 52. The exhaust manifold 52 is in turn coupled to an exhaust conduit 54. The exhaust runners 50, exhaust manifold 52, and exhaust conduit 54 are included in the exhaust system 48. The exhaust system 48 also includes an emission control device 56 coupled to the exhaust conduit 54. The emission control device 56 may include filters, catalysts, absorbers, etc., for reducing tailpipe emissions.

During engine operation, the cylinder 18 typically undergoes a four stroke cycle including an intake stroke, compression stroke, expansion stroke, and exhaust stroke. During the intake stroke, generally, the exhaust valves close and intake valves open. Air is introduced into the cylinder via the corresponding intake passage, and the cylinder piston moves to the bottom of the cylinder so as to increase the volume within the cylinder. The position at which the piston is near the bottom of the cylinder and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the cylinder. In a process herein referred to as ignition, the injected fuel in the combustion chamber is ignited via a spark from an ignition device (e.g., spark plug) and/or compression, in the case of a compression ignition engine. During the expansion stroke, the expanding gases push the piston back to BDC. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIG. 1 also shows a controller 100 in the vehicle 10. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 12. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Furthermore, the controller 100 may be configured to trigger one or more actuators and/or send commands to components. For instance, the controller 100 may trigger adjustment of the throttle 22, intake valve actuators 30, exhaust valve actuators 34, ignition system 44, and/or fuel delivery system 14. Specifically, the controller 100 may be configured to send signals to the ignition device 46 and/or direct fuel injector 36 to adjust operation of the spark and/or fuel delivered to the cylinder 18. Therefore, the controller 100 receives signals from the various sensors and employs the various actuators to adjust engine operation based on the received signals and instructions stored in memory of the controller. Thus, it will be appreciated that the controller 100 may send and receive signals from the fuel delivery system 14.

For example, adjusting the direct fuel injector 36 may include adjusting a fuel injector actuator to adjust the direct fuel injector. In yet another example, the amount of fuel to be delivered via the direct fuel injector 36 may be empirically determined and stored in predetermined lookup tables or functions. For example, one table may correspond to determining direct injection amounts. The tables may be indexed to engine operating conditions, such as engine speed and engine load, among other engine operating conditions. Furthermore, the tables may output an amount of fuel to inject via direct fuel injector to the cylinder at each cylinder cycle. Moreover, commanding the direct fuel injector to inject fuel may include at the controller generating a pulse width signal and sending the pulse width signal to the direct fuel injector.

FIG. 2 shows a cross-section of an example of the engine 12. The engine 12 is shown including a cylinder block 200 coupled to a cylinder head 202 forming the cylinder 18. One of the exhaust valves 32 and one of the intake valves 28, are shown in FIG. 2. Therefore, it will be appreciated that the additional exhaust and intake valves are hidden from view in FIG. 2. However, in other examples, only one intake and one exhaust valve may be coupled to the cylinder.

Additionally, a piston 204 is disposed within the cylinder 18 and connected to a crankshaft 206. The direct fuel injector 36 and specifically a nozzle 208 of the direct fuel injector 36 is shown positioned in an upper region of the cylinder 18 with regard to a central axis 210 of the cylinder 18. Additionally, the direct fuel injector 36 is also positioned horizontally between the intake valve 28 and the exhaust valve 32, in the illustrated example. Specifically, the nozzle 208 of the direct fuel injector 36 is position between the intake valve 28 and the exhaust valve 32 with regard to a horizontal axis. Coordinate axes X and Z are provided for reference. In one example, the Z axis may be parallel to a gravitational axis. Further, the X axis may be a lateral or horizontal axis.

FIG. 2 also shows one of the intake runners 26 in fluidic communication with the intake valve 28. Likewise, FIG. 2 additionally shows one of the exhaust runners 50 in fluidic communication with the exhaust valve 32. It will be appreciated that the exhaust runner, shown in FIG. 2, flows exhaust gas to downstream components in the exhaust system. On the other hand, the intake runner shown in FIG. 2 receives intake air from upstream intake system components.

The direct fuel injector 36 is also shown receiving fuel from a fuel source in the fuel delivery system 14, shown in FIG. 1. It will be appreciated that the fuel source may be one or more of the upstream components in the fuel delivery system, such as a fuel conduit, fuel pump, fuel tank, fuel rail, etc. In FIG. 2, the direct fuel injector 36 is shown centrally located relative to a central axis of the cylinder (e.g., combustion chamber) 18. However, in alternate embodiments, the direct fuel injector 36 may be positioned asymmetrically with respect to the central axis (e.g., offset from center so that the injector 36 is closer to one side of the cylinder 18 than an opposite side of the cylinder).

FIG. 3A shows a detailed view of the direct fuel injector 36, shown in FIG. 2. The direct fuel injector 36 includes a body 300 and central axis 301. The body 300 is configured to receive fuel from a fuel source in the fuel delivery system 14, shown in FIG. 1. The body 300 may include an actuator (e.g., solenoid) that receives control signals from the controller 100, shown in FIG. 1.

Continuing with FIG. 3A, the direct fuel injector 36 further includes the nozzle 208 configured to spray metered amounts of fuel into the cylinder 18, shown in FIG. 2. An example orifice angle 302, is shown in FIG. 3A. The orifice angle 302 may correspond to a single orifice (e.g., hole or nozzle hole) included in the nozzle 208. Specifically in one example, the orifice angle 302 may be a theta angle (θ) of the associated orifice. The orifice angle 302 may be defined between the central axis (or flow axis) of the orifice and a vertical axis of the direct fuel injector 36.

FIG. 3B shows a detailed view, as shown by box 304 in FIG. 3A, of the nozzle 208 of the direct fuel injector 36 shown in FIG. 3A. Specifically, FIG. 3B shows the nozzle 208, including a needle 306 seated against a needle seat 308 of a body 310 of the nozzle 208. A nozzle tip 314 of the nozzle 208 includes a plurality of nozzle holes (e.g., orifices) 316 that connect to a sac 312 of the nozzle 208 and are arranged around the central axis 301. When the needle 306 is retracted away from the needle seat 308, fuel may flow into the sac 312 and out the nozzle holes 316. Each nozzle hole 316 has a central, flow axis 318 that is straight, from an inlet 324 to an outlet 326 of the nozzle hole 316, and centered through the nozzle hole 316. As discussed further below with reference to FIGS. 4A-9, the nozzle holes 316 are twisted nozzle holes with a cross-section (arranged normal to the flow axis 318) that twists about the straight flow axis 318. Thus, fuel injected from the twisted nozzle holes 316 has two components: a straight component 320 (which is oriented parallel with the central flow axis 318) and a rotating component 322. These two velocity components enhance mixing due to the additional motion of the injected spray and reduce surface wetting by decreasing the travel distance of the spray, as explained in further detail below.

FIG. 4A shows a three-dimensional view of an embodiment of a twisted nozzle hole 400 for a fuel injector, such as fuel injector 36 shown in FIGS. 1-3B. Nozzle hole 400 shown in FIG. 4A is shown as a solid form for illustration of the shape of the nozzle hole. In this way, nozzle hole 400 is presented as a negative of the actual nozzle hole. Thus, in a nozzle (e.g., nozzle 208 shown in FIG. 3B), the form of nozzle hole 400 is actually empty space, with the shape of nozzle hole 400 formed by walls of the body of the nozzle tip. Alternate embodiments of the shape of the twisted nozzle hole are shown in FIG. 6, as discussed further below.

Nozzle hole 400 has an inlet 402 (corresponds to inlet 324 shown in FIG. 3B, in one example) and outlet 404 (corresponds to outlet 326 shown in FIG. 3B, in one example), where an entire length 406 of nozzle hole 400 is arranged between the inlet 402 and outlet 404. The injection direction 410 of fuel injected via nozzle hole 400 is shown in FIG. 4A and is parallel to the straight flow axis 408. Nozzle hole 400 has a cross-section which twists (e.g., rotates) around the straight (e.g., linear and non-curved) flow axis 408 of nozzle hole 400. The flow axis 408 is centered within the nozzle hole 400, from the inlet 402 to the outlet 404, and arranged parallel with the length 406 of nozzle hole 400. The cross-section of nozzle 400, taken at a plurality of different cutting planes along the length 406 of nozzle hole 400, is shown in FIG. 4B.

Specifically, FIG. 4A shows seven cutting planes 411, 412, 413, 414, 415, 416, and 417 and FIG. 4B shows the cross-section of nozzle hole 400 at each of the seven cutting planes. Each cutting plane is arranged normal (e.g., perpendicular) to the straight flow axis 408. FIG. 4B shows cross-sections, 421, 422, 423, 424, 425, 426, and 427, which correspond to cutting planes 411, 412, 413, 414, 415, 416, and 417, respectively. Cutting plane 411 is taken approximately at (e.g., proximate to) the inlet 402 and cutting plane 417 is taken approximately at (e.g., proximate to) the outlet 404, with all remaining cutting planes taken at a different location between the inlet 402 and outlet 404. Each of the cross-sections shown in FIG. 4B are rectangular (e.g., slit-shaped) in shape. However, nozzle holes with alternate-shaped cross-sections are also possible. Alternate embodiments of the twisted nozzle hole cross-section are shown in FIG. 7, as discussed further below.

As shown in FIG. 4B, each of the cross-sections 421-427 has a short side 430 having length 432 and long side 434 having length 436. In particular, since the cross-sections are rectangular, each cross-section has two short sides 430 (with identical length) and two long sides 434 (with identical length). Each cross-section has a section axis that runs through a center of the cross-section and is arranged parallel with the short side 430. For example, each of cross-sections 421, 422, 423, 424, 425, 426, and 427 has a section axis 441, 442, 443, 444, 445, 446, and 447, respectively. The first section axis 441 of first cross-section 421 is shown at each of the cross-sections to illustrate how much each cross-section has twisted (e.g., rotated) relative to the first section axis 441 of the first cross-section 421, taken proximate to the inlet 402 via cutting plane 411. Thus, each of cross-sections 422, 423, 424, 425, 426, and 427 have a rotation angle 452, 453, 454, 455, 456, and 457, respectively, defined between each corresponding section axis and the first section axis 441. As seen in FIG. 4B, each of rotation angles 452, 453, 454, 455, 456, and 457 increase in size for each subsequent cutting plane, from the inlet 402 to the outlet 404. For example, rotation angle 457 is the largest and larger than rotation angle 452 which is the smallest (other than the first cross-section 421 which has a rotation angle of zero since it is the reference point for all other cross-sections). The rotation angle 457, at the outlet 404, may be in a range of 45 to 90 degrees. In another example, the rotation angle 457 may be at least 45 degrees. In yet another example, the rotation angle 457 may be at least 75 degrees. In yet another example, the rotation angle 457 may be in a range of 60 to 270 degrees. The rotation (e.g., twisted) angle may be determined by considering the travel distance (and/or size) of spray combined with the injector nozzle design parameters such as aspect ratio of cross-section, length of nozzle hole, and shape of nozzle cross-section (e.g. when all the nozzle hole design parameters are the same, the rotation (twisted) angles could be different for a high aspect ratio nozzle and a low aspect ratio nozzle for the same travel distance). In this way, the angle of rotation of the cross-section of nozzle hole 400 from the inlet 402 to the outlet 404 is in a range of 60-270 degrees, and in some embodiments, may be at least 45 degrees, at least 60 degrees, at least 75 degrees, in a range of 60 to 90 degrees, or at least 90 degrees. As shown in FIG. 4B, the cross-section of nozzle hole 400 may twist continuously around (e.g., about) the straight flow axis 408, from the inlet 402 to the outlet 404.

Additionally, as shown in FIG. 4B, the length 436 of the long side 434 for the seventh cross-section 427, taken at cutting plane 417 arranged at/proximate to the outlet 404, is longer than that of the first cross-section 421, taken at cutting plane 411, arranged at/proximate to the inlet 402. The embodiment of nozzle hole 400 shown in FIGS. 4A-4B is a stepped nozzle hole where the long side 434 of the cross-section of nozzle hole 400 increases, in a step fashion, from a smaller size to a larger size, at a location partway along the length 406, between the inlet 402 and the outlet 404. For example, as shown in FIGS. 4A-4B, the step increase in length 436 of long side 434 occurs at cutting plane 413, which is the third cutting plan shown in FIG. 3A and occurs a first distance 418 into the nozzle hole 400 from the inlet 402 and a second distance 420 into the nozzle hole 400 from the outlet 404. In the example shown in FIG. 4A, the second distance 420 is larger than the first distance 418 such that the step increase in the long side of the cross-section occurs closer to the inlet 402 than the outlet 404, but still spaced a distance away from the inlet 402. For example, the step increase may occur closer to a mid-point of the length 406 of nozzle hole 400 than to the inlet 402 or outlet 404. In alternate embodiments, the step increase in length 436 of long side 434 may occur at a different position along length 406 and may be bigger or smaller than that shown in FIGS. 4A-4B. In some examples, after the step increase, the long side 434 of the cross-section may continue to increase (e.g., monotonically or continuously) in length to the outlet 404. In alternate embodiments, length 436 of long side 434 may be substantially the same in size before and after the step increase. As shown in FIG. 4B, the length 432 of the short side 430 of each cross-section may be substantially the same (e.g., identical) along the length 406. However, in alternate embodiments, the length 432 of the short side 430 for the cross-section of nozzle hole 400 may decrease along the length 406, from the inlet 402 to the outlet 404. In this way, the length 432 of short side 430 may be longer at the inlet 402 than the outlet 404. In all embodiments, the length 436 of long side 434 is at least two times larger than the length 432 of short side 430 at the outlet 404 (e.g., at cross-section 427, corresponding to cutting plane 417).

The twisted flow passage of the slit-shaped nozzle hole 400 may produce a wide spray shape with short penetration depth (e.g., distance from nozzle to cylinder wall) by adjusting the aspect ratio (length 436 of long side 434 divided by length 432 of short side 430) of the cross-section and the twisted angle (e.g., rotation angle 457). For example, the spray characteristics of the fuel injector, including the width of the spray shape and penetration depth may be adjusted by individually adjusting the aspect ratio and rotation angle (e.g., degree of twisting) of each nozzle hole. The twisted passage of the nozzle hole, shown in the example of FIGS. 4A-4B, imposes a rotational force with respect to the injection direction 410 on each spray and produces a wider spray shape with shorter penetration depth than an injector having nozzle holes without a twisted passage. The rotational force on the spray may be controlled by the rotation angle (from the inlet to the outlet of the nozzle hole) and the aspect ratio. For example, the larger the aspect ratio and rotation angle (e.g., twisted angle), the higher the rotational force, and thus the wider the spray shape and shorter the penetration depth. While the slit (e.g., rectangular) shape of the cross-section (such as the cross-sections shown in FIG. 4B) enables the rotational force imposed on the spray, alternate shapes with a similar overall geometry (e.g., still having a longer and shorter side, relative to one another) are also possible with similar results, such as the alternate shapes shown in FIG. 7, as described further below. Liquid spray inside the slit nozzle hole moves freely in the rotational direction, according to the rotational force. Additionally, the spray droplet size may be controlled by adjusting the length 432 of short side 430 of the cross-section. For example, the spray droplet size may decrease for decreasing size of the short side of the cross-section.

FIG. 5 shows a cross-sectional view of an embodiment of the nozzle included in the direct fuel injector shown in FIGS. 3A-3B, the view being from an inlet side of nozzle holes of the nozzle. Specifically, FIG. 5 shows nozzle 208, central axis 301, and a plurality of nozzle holes 502 arranged in an arc around the central axis 301 of nozzle 208. Specifically, in the depicted example, the nozzle holes (e.g., orifices) 502 circumferentially surround the central axis 301 at equivalent radii. However, in other instances, the nozzle holes 502 may only extend part of the way around the central axis 301 or may include groups of nozzle holes spaced away from each other on different sides of the nozzle 208. In yet another example, the plurality of nozzle holes 502 many have varying radii with regard to the central axis. Furthermore, each of the nozzle holes 502 may be arranged at a common vertical position (e.g., depth) with regard to the central axis 301 of the nozzle 208, in one example.

The nozzle holes 502 are viewed from the inlet side of the nozzle holes in FIG. 5 and are twisted nozzle holes, such as one of the twisted nozzle holes described herein (e.g., nozzle hole 400 shown in FIGS. 4A-4B). In the example shown in FIG. 5, each of nozzle holes 502 have a rectangular (e.g., slit shaped) cross-section that twists around the straight flow axis of the nozzle hole 502. The fanned shape of each of nozzle holes 502, with a central space 504, centered at the straight flow axis, depicts the twisting arrangement. The central space 504 is the common flow passage at each cross-section taken along the straight flow axis, from the inlet to the outlet. Though six nozzle holes 502 are shown in FIG. 5, in alternate embodiments, the nozzle 208 may include more or less than six twisted nozzle holes 502. The angle of each nozzle holes 502 relative to the central axis 301 may be adjusted based on the location of the fuel injector within the cylinder (e.g., centrally located vs. offset from the central cylinder axis), and thus, vary distances between each nozzle hole 502 and walls of the cylinder. Further, the aspect ratio and rotation angle, as described above with reference to FIGS. 4A-4B, of each nozzle hole 502 may be varied to achieve the desired penetration depth based on distance of each nozzle hole 502 to the cylinder wall of the cylinder in which the injector is positioned. As described above, by controlling the aspect ratio and rotation angle of each twisted nozzle hole 502, both the injection direction and penetration depth (e.g., travel distance of the spray from the nozzle hole) may be controlled simultaneously. This results in increased fuel/air mixing and reduced surface wetting. This simultaneous control is not possible in alternate fuel injectors having nozzle holes with a single velocity components and/or fuel sprays that are symmetric with respect to the central axis of the fuel injector.

FIG. 6 shows a three-dimensional view of additional embodiments of a twisted nozzle hole for a fuel injector, such as fuel injector 36 shown in FIGS. 1-3. Specifically, FIG. 6 shows a second embodiment of a twisted nozzle hole 604 and a third embodiment of a twisted nozzle hole 606. Similarly to nozzle hole 400 shown in FIG. 4A, each of nozzle holes 604 and 606 are shown as a solid form for illustration of the shape of the nozzle hole. In this way, nozzle holes 604 and 606 are presented as a negative of the actual nozzle holes. Thus, in a nozzle (e.g., nozzle 208 shown in FIG. 3B), the forms of nozzle holes 604 and 606 are actually empty space, with the shapes of the nozzle holes formed by walls of the body of the nozzle tip. Nozzle holes 604 and 606 may include similar features to that of nozzle hole 400, as discussed above with reference to FIGS. 4A-4B, including having a cross-section that twists around a straight flow axis 602 of each nozzle hole, from an inlet end 608 to an outlet end 610 of each nozzle hole. Similarly to FIGS. 4A-4B, nozzle holes 604 and 606 have a rectangular (slit) cross-section. However, in alternate embodiments, different shaped cross-sections, with an elongated shape, are possible.

As shown in FIG. 6, nozzle hole 604 has a rectangular cross-section that has a rotation (e.g., twist) angle, from the inlet end 608 to the outlet end 610, of approximately 90 degrees with a modified inlet. For example, the inlet of nozzle hole 604 may have a different cross-sectional area and starting angle than that of nozzle hole 400 shown in FIG. 4A. Additionally, nozzle hole 604 does not include a step (e.g., step increase in the length of the long side of the cross-section). Instead, the long side of the cross-section of nozzle hole 604 increases monotonically from the inlet end 608 to the outlet end 610. Nozzle hole 606 also includes a modified inlet, a rotation angle of approximately 90 degrees, but has a step increase in length of the long side of the cross-section. The modified inlet of nozzle hole 604 and nozzle hole 606 have the same cross-sections, a square, which have the aspect ratio of 1. However, for each of nozzle hole 604 and nozzle hole 606, the cross-section of the nozzle hole changes from the square shape at the inlet to a rectangular shape at the outlet. Thus, the cross-sections of each of nozzle hole 604 and nozzle hole 606 twist around the straight flow axis 602 and have two oppositely arranged sides that increase in length from the inlet to the outlet (e.g., the square transitions into rectangle by increasing the length of two of the opposing sides of the cross-section). Thus, the cross-section of nozzle holes 604 and 606, at the outlet end 610 may be shaped similar to that of the nozzle hole 400 (at the outlet). Thus, in the examples shown in FIG. 6, the cross-section of the nozzle holes is a rectangle (e.g., quadrilateral) where the shape of the cross-section at the inlet is a square (which all sides of the square having equal length)

and the shape of the cross-section at the outlet is a rectangle having two oppositely arranged longer sides and two oppositely arranged shorter sides (e.g., not having all sides of equal length).

The square cross-section inlets are selected to fit inside the nozzle area allowed for the hole inlets. When the cross-section of the nozzle hole inlets have a high aspect ratio (thin and long), the nozzle hole inlets may be too close to each other and/or portions of the nozzle hole inlets may be located outside of the area allowed for the inlets. The square cross-section, which is the lowest value of the aspect ratio from the rectangular cross-section and has sides of the same length, may allow for the multiple nozzle holes having this shaped inlet cross-section to fit within the space allowed for the nozzle hole inlets since they do not have a long (e.g., longer) side (as compared to another side of the cross-section). The square-shaped inlet would be an inlet shape that fits into the smaller area for the multiple nozzle holes while still generating the twisting effect. However, in alternate embodiments, other shapes for the nozzle holes and nozzle inlets are possible as long as the passages twist, as discussed herein.

Turning to FIG. 7, alternative embodiments for the shape of the cross-section of the twisted nozzle hole (which may be one of the nozzle holes discussed above and shown in the figures) are shown. Instead of the rectangular (e.g., slit) shaped cross-section shown in FIGS. 4A-4B and 5-6, the twisted nozzle hole may have a barbell shape (e.g., rectangle with circular ends) 702, a double-triangle shape (e.g., two elongated triangles coupled together at pointed ends) 704, an elongated diamond shape 706, or an elongated oval shape 708. In each of these alternative shapes, the cross-section has a long side that is at least two times longer than a short side of the shape. Additional alternate shapes that include four, elongated ends extending from a central section, and symmetric about the central section, include a plus shape 710, a double-barbell shape that overlaps at the center 712, and a shape that includes two sets of double-triangles that connect at the center via pointed ends 714. Each of the alternate cross-section shapes shown in FIG. 7 may twist about a straight flow axis of the nozzle hole, which is centered at a center of the shape.

FIG. 8 shows an embodiment of a modified nozzle hole passage (instead of the singular, straight flow passage shown in FIG. 3A) 800 which includes a straight nozzle hole passage 802 that bifurcates into two angled nozzle hole passages 804 that have a separation angle θ. Flow into the straight nozzle hole passage 802 is shown by arrow 806. The cross-sections of the two angled nozzle hole passages 804 may then twist about a central axis 808 of the modified nozzle hole passage, as shown by arrow 810. Varying the separation angle θ may additionally affect and vary the rotational force imparted on the fuel spray by the passage.

FIG. 9 shows example shapes of the cross-sections of the two angled nozzle hole passages 804 of the modified nozzle hole passage 800 of FIG. 8. The cross-section shapes may include separated rectangles 902, separated triangles (pointed ends facing one another) 904, four separated rectangles 906, and four separated triangles 908.

FIGS. 2-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, a fuel injector with a multi-hole nozzle may include a plurality of separate nozzle holes for injecting fuel into a cylinder at different, individual angles. Each of the nozzle holes has a straight flow axis and a cross-section (defined normal to the straight flow axis) that rotates around the flow axis, from an inlet to an outlet of the nozzle hole. In this way, a fuel spray exiting each individual nozzle hole has two velocity components: a straight velocity component and a rotational velocity component, where the rotational velocity components for each nozzle hole are individual and separate from one another. The multi-hole injector enables the angle of each hole to be individually adjusted based on different injector positions within the cylinder (e.g., offset from a cylinder axis or centered along the cylinder axis). Further, as discussed above, having a nozzle with individual nozzle holes, each with a twisted flow passages (rotating cross-section) enables simultaneous control of the travel direction and distance (penetration depth) of the fuel spray. By adjusting the twist angle and the aspect ratio of the nozzle hole, the spray shape (e.g., width of spray shape) and penetration depth may be controlled in order to reduce surface wetting and increasing mixing, thereby decreasing emissions. In some embodiments, the shape of the cross-section of the nozzle hole may be rectangular (e.g., slit-like) which may be advantageous in adjusting the spray shape and penetration depth to desired levels. However, alternate cross-section shapes, which have a long side at least twice as long as a short side of the cross-section are also possible. The technical effect of a fuel injector nozzle including a plurality of nozzle holes, each nozzle hole having a straight flow axis, along a length of each nozzle hole, and a cross-section that twists around the straight flow axis, from an inlet to outlet of each nozzle hole, where the straight flow axis runs through a center of the cross-section, is to reduce surface wetting and increase fuel/air mixing, while at the same time adjusting for individual, desired travel directions.

As one embodiment, a nozzle of a fuel injector includes a plurality of nozzle holes, each nozzle hole having a straight flow axis, along a length of each nozzle hole, and a cross-section that twists around the straight flow axis, from an inlet to outlet of each nozzle hole, where the straight flow axis runs through a center of the cross-section. In a first example of the nozzle, the straight flow axis is arranged at an angle relative to a central axis of the fuel injector, wherein the plurality of nozzle holes are spaced apart from one another and arranged around the central axis, and wherein the straight flow axis is arranged normal to the cross-section. A second example of the nozzle optionally includes the first example and further includes, wherein the cross-section is rectangular, the rectangular cross section having a long side and a short side and wherein the long side is at least two times longer than the short side at the outlet of each nozzle hole. A third example of the nozzle optionally includes one or more of the first and second examples, and further includes wherein a cross-sectional area of the cross-section of each nozzle hole is larger at the outlet than the inlet. A fourth example of the nozzle optionally includes one or more of the first through third examples, and further includes wherein the cross-section of each nozzle hole has a step increase in cross-sectional area at a location within the nozzle hole, between the inlet and outlet. A fifth example of the nozzle optionally includes one or more of the first through fourth examples, and further includes wherein, for each nozzle hole, the cross-section at the outlet is twisted by at least 60 degrees from the cross-section at the inlet. A sixth example of the nozzle optionally includes one or more of the first through fifth examples, and further includes wherein the cross-section has a shape of one of an elongated diamond, an elongated oval, an elongated barbell, and a double-triangle.

As another embodiment, a nozzle of a fuel injector includes a plurality of nozzle holes, each nozzle hole having a straight flow axis and a cross-section that rotates around the axis from an inlet to an outlet of each nozzle hole, a long side of the cross-section changing in length from the inlet to the outlet. In a first example of the nozzle, the cross-section is rectangular and the long side increases in length from the inlet to the outlet. A second example of the nozzle optionally includes the first example and further includes, wherein the long side of the rectangular cross-section is at least two times larger at the outlet than the inlet. A third example of the nozzle optionally includes one or more of the first and second examples, and further includes, wherein the cross-section rotates at least 75 degrees around the axis, from the inlet to the outlet. A fourth example of the nozzle, wherein the cross-section rotates in a range of 60 to 90 degrees around the axis, from the inlet to the outlet. A fifth example of the nozzle optionally includes one or more of the first through fourth examples, and further includes, wherein the cross-section is shaped as one of a barbell, double-triangle, diamond, elongated oval, plus, overlapping double barbell, and two overlapping double triangles. A sixth example of the nozzle optionally includes one or more of the first through fifth examples, and further includes, wherein the long side of the cross-section monotonically increases in length from the inlet to the outlet. A seventh example of the nozzle optionally includes one or more of the first through sixth examples, and further includes, wherein the long side of the cross-section has a step increase in length at a location partway between the inlet and the outlet. An eighth example of the nozzle optionally includes one or more of the first through seventh examples, and further includes, wherein the long side of the cross-section is at least two times larger than a short side of the cross-section along an entirety of a length of each nozzle hole.

As yet another embodiment, a fuel injector includes a nozzle including a nozzle tip at an end of a body of the nozzle, the nozzle tip including a plurality of nozzle holes, each nozzle hole having an inlet arranged at an internal sac of the nozzle and an outlet arranged at an exterior of the nozzle tip, each nozzle hole having a straight flow axis arranged at an angle relative to a central axis of the body of the nozzle and a cross-section that twists around the straight flow axis from the inlet to the outlet of each nozzle hole; and a needle adapted to seat against a needle seat of the body of the nozzle. In a first example of the fuel injector, the cross-section has a long side and a short side, where the long side increases in length from the inlet to the outlet. A second example of the fuel injector optionally includes the first example and further includes, wherein a shape of the cross-section is a slit and wherein at the outlet, the long side is at least twice as long as the short side. A third example of the fuel injector optionally includes one or more of the first and second examples, and further includes, wherein the short side remains constant or decreases in size, along a length of each nozzle hole, from the inlet to the outlet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A nozzle of a fuel injector, comprising:

a plurality of nozzle holes, each nozzle hole having a passage that bifurcates into at least two angled nozzle hole passages, the at least two angled nozzle hole passages having a straight flow axis, along a length of each angled nozzle hole, and a cross-section that twists around the straight flow axis, from an inlet to an outlet of each angled nozzle hole, wherein the straight flow axis runs through a center of the cross-section.

2. The nozzle of claim 1, wherein the straight flow axis is arranged at an angle relative to a central axis of the fuel injector, wherein the plurality of nozzle holes is spaced apart from one another and arranged around the central axis, and wherein the straight flow axis is arranged normal to the cross-section.

3. The nozzle of claim 1, wherein the cross-section has a shape of a rectangle, and wherein the rectangular cross-section has a long side and a short side, and wherein the long side is at least two times longer than the short side at the outlet of each nozzle hole.

4. The nozzle of claim 1, wherein a cross-sectional area of the cross-section of each nozzle hole is larger at the outlet than the inlet.

5. The nozzle of claim 4, wherein the cross-section of each nozzle hole has a step increase in cross-sectional area at a location within the nozzle hole, between the inlet and the outlet.

6. The nozzle of claim 1, wherein, for each nozzle hole, the cross-section at the outlet is twisted by at least 60 degrees from the cross-section at the inlet.

7. A nozzle of a fuel injector, comprising:

a plurality of nozzle holes, each nozzle hole having a straight flow axis and a cross-section that rotates around the axis from an inlet to an outlet of each nozzle hole, a long side of the cross-section changing in length from the inlet to the outlet, wherein the long side of the cross-section has a step increase in length at a location partway between the inlet and the outlet.

8. The nozzle of claim 7, wherein the cross-section has a shape of a rectangle, and wherein the long side of the rectangular cross-section increases in length from the inlet to the outlet.

9. The nozzle of claim 8, wherein the long side of the rectangular cross-section is at least two times larger at the outlet than the inlet.

10. The nozzle of claim 7, wherein the cross-section rotates at least 75 degrees around the axis, from the inlet to the outlet.

11. The nozzle of claim 7, wherein the cross-section rotates in a range of 60 to 90 degrees around the axis, from the inlet to the outlet.

12. The nozzle of claim 7, wherein the long side of the cross-section monotonically increases in length from the inlet to the outlet.

13. The nozzle of claim 7, wherein the long side of the cross-section is at least two times larger than a short side of the cross-section along an entirety of a length of each nozzle hole.

14. A fuel injector, comprising:

a nozzle including a nozzle tip at an end of a body of the nozzle, the nozzle tip including a plurality of nozzle holes, each nozzle hole having an inlet arranged at an internal sac of the nozzle and an outlet arranged at an exterior of the nozzle tip, each nozzle hole having a straight flow axis arranged at an angle relative to a central axis of the body of the nozzle and a cross-section that twists around the straight flow axis from the inlet to the outlet of each nozzle hole, where the cross-section of each nozzle hole has a step change in cross-sectional area at a location partway between the inlet and the outlet; and a needle adapted to seat against a needle seat of the body of the nozzle.

15. The fuel injector of claim 14, wherein the cross-section has a long side and a short side, where the long side increases in length from the inlet to the outlet.

16. The fuel injector of claim 15, wherein a shape of the cross-section is a slit and wherein, at the outlet, the long side is at least twice as long as the short side.

17. The fuel injector of claim 16, wherein the short side remains constant or decreases in size, along a length of each nozzle hole, from the inlet to the outlet.

* * * * *